US008152618B1

(12) United States Patent
Blay et al.

(10) Patent No.: US 8,152,618 B1
(45) Date of Patent: Apr. 10, 2012

(54) ADVANCEMENTS IN COMPUTERIZED POKER TRAINING AND ANALYSIS

(76) Inventors: Steven Patrick Blay, Gainesville, FL (US); Allen Dennis Blay, Tallahassee, FL (US)

( * ) Notice: Subject to any disclaimer, the term of this patent is extended or adjusted under 35 U.S.C. 154(b) by 445 days.

(21) Appl. No.: 12/419,283

(22) Filed: Apr. 6, 2009

Related U.S. Application Data

(60) Provisional application No. 61/042,716, filed on Apr. 5, 2008.

(51) Int. Cl.
*A63F 9/24* (2006.01)

(52) U.S. Cl. ..... 463/13

(58) Field of Classification Search ..... 463/13, 463/29, 42
See application file for complete search history.

(56) References Cited

U.S. PATENT DOCUMENTS

2003/0109310 A1* 6/2003 Heaton et al. ..... 463/42
2007/0167228 A1 7/2007 Tormey
2007/0203971 A1* 8/2007 Walker et al. ..... 709/201

* cited by examiner

*Primary Examiner* — Brook Kebede

(57) ABSTRACT

A training and analysis method and system for the card game poker are disclosed. Some embodiments can be run in an Internet browser. Some embodiments introduce "dynamic analysis", which examines the end user's long term strengths and weaknesses. In other words, the analysis is done considering all the end user's actions both individually and as a whole picture. The end user can receive a detailed analysis of past performance at any point in the poker session.

20 Claims, 4 Drawing Sheets

| Skills, Errors, and Game Factors | |
|---|---|
| 501 | Folding a hand that should be played (playing too tight) |
| 502 | Playing a weak hand (non aces) – pre-flop and post-flop |
| 503 | Playing Weak Aces – just pre-flop |
| 504 | Limping in as first in with position |
| 505 | Blind Defense Error (calling a hand that should be folded) |
| 506 | Blind Defense Error (folding a hand that should be played) |
| 507 | Playing a hand with poor pot odds in the situation |
| 508 | Overbetting (bet size too high) |
| 509 | Playing too aggressively (e.g., raising in bad position, raising too much) |
| 510 | Passive betting (bet/raise size too low) |
| 511 | Steal Attempt – pre-flop, this is blind stealing |
| 512 | Passive Play 1 (calling when a raise was called for) |
| 513 | Passive Play 2 (checking when a bet s/b made) |
| 514 | Ignoring previous action (e.g., failure to respect a pre-flop raiser) |
| 515 | Continuation Bet |
| 516 | Calling a raise when a fold or re-raise should be done |
| 517 | Possible situation for a slowplay |
| 518 | Check-Raise |
| 519 | Possible situation for a continuation bet defense |
| 520 | Betting or check-raising a strong drawing hand |
| 521 | Firing a second continuation bet on the turn |
| 522 | Possible situation for a bluff |
| 523 | Going all in |
| 524 | Ignoring opponent's tendencies |
| 525 | Pot Committed |
| 526 | Semi-bluff (e.g., with a medium strength draw) |
| 527 | Pot Control problem |
| 528 | Blocking bet |
| 529 | Error playing against a short-stack |
| 530 | Folding when no bet has been made |
| 531 | Playing deceptively when standard play would be perfectly acceptable |

FIGURE 3

| SKILL CATEGORY | YOUR SCORE |
|---|---|
| | |
| Overall (mean score) | 107 |
| Pre-flop | 114 |
| Flop | 98 |
| Turn | 115 |
| River | 122 |
| Bet Size | 106 |
| Appropriately Aggressive Play | 104 |
| Adjusting to Opponents' Style | 88 |
| Respecting Previous Action | 89 |
| Timing Your Strategic Moves | 110 |
| Position | 110 |
| Bluffing | 115 |

FIGURE 4

ADVANCEMENTS IN COMPUTERIZED POKER TRAINING AND ANALYSIS

CROSS-REFERENCE TO RELATED APPLICATIONS

This application claims the benefit of provisional patent application Ser. No. 61/042,716, "Intelligent Computerized Poker Training and Analysis", filed 2008 Apr. 5 by the present inventors.

FEDERALLY SPONSORED RESEARCH

Not Applicable

SEQUENCE LISTING OR PROGRAM

Not Applicable

BACKGROUND

1. Field of Invention

This invention relates to evaluating an individual's performance in a poker game.

2. Prior Art

Legalized gaming has evolved from a simple, social pastime into a major commercial enterprise. Poker, in particular, due to its many variations, easy to understand rules, group participation nature and variability of stakes, has become the game of choice for popular gambling. At any given time, 24 hours of every day of every week of the year, many thousands of people world-wide will be playing poker at social or, more often, commercial venues, including card rooms, casinos, stand-alone console games, personal electronic games and on-line gambling facilities. There are even several television shows and magazines devoted exclusively to poker.

Poker is big business, and therefore it should be no surprise that poker training is big business as well. There are professional coaches, the best of which charge hundreds of dollars an hour for their services. Then there are poker training Websites and installable poker software programs.

Looking first at poker training Websites (that usually charge a fee to be a member), most of these have training documents for members to read, and videos (that can be watched over the Internet) of professional poker players explaining their techniques while playing in Internet poker games. But a longstanding need has been felt for a software program that can run in an Internet Browser and can give quality analysis and advice in a true-to-life poker game setting. There were some barriers to such software being successfully developed, and we reveal in this invention how to overcome those barriers.

There are several installable poker software programs (those that do not run in an Internet Browser) noted below that give simplified advice and an overabundance of statistics. These are difficult for the average player to apply correctly. In this document we will reveal a much more comprehensive and accurate form of advice based on what we call "dynamic analysis".

Transitioning now to patented prior art, we find that there is very little patented prior art related to analysis of poker. Most patented prior art has centered around trying to make improvements to the game of poker itself. For example, U.S. Pat. Nos. 7,222,856 and 7,264,243 detail improved poker games for casino play. U.S. Pat. No. 6,863,274 attempts to combine poker and blackjack.

The closest published patent application to the current invention is 2007/0167228 (Computer Based Performance Analysis of Games, Peter J. Tormey). Some of the limitations of the Tormey application are:

1. The method and system disclosed associate "rules" with "recommended actions". While a limited number of poker situations (such as pre-flop poker) can be analyzed by rigid rules as such, poker is a dynamic game and rules are of little value in more complex situations, or when applied over a series of poker hands against the same opponents.
2. The method and system disclosed only allow review of game histories after the fact, as opposed to the more convenient and useful method of feedback during game play.
3. The method and system disclosed model optimal play based on the winner's performance (the winner being the player who wins the most money or wins the poker tournament). Because of the element of luck in poker, quite often an inferior player can be a winner in the short run, leading to poor analysis.

To best look at prior art in the field, we should look back at poker software again. Poker software has been around for a long time. Most recent developments in software in the private sector are:

1. Software that allows human player versus human player poker games (many such games are available that connect players to each other over the Internet). These programs allow players to compete for real or play money but no training is provided outside of the experience of playing the game itself. This method of training is not very efficient, and costly if playing for real money.
2. Commercially available poker training and tracking software. Some examples of such software and their limitations as compared to the current invention:
   a) Turbo Texas Hold'em (Wilson Software)—allows the user to play poker against computerized opponents, and at each decision point it presents limited advice, such as "You should fold here", "You should raise here", etc. Also give statistics such as the percentage of hands you have played to the flop, the amount of chips won/lost, etc. This software, however, cannot be run in an Internet browser and does not use dynamic analysis over a series of decision points.
   b) Poker Academy Pro (Biotools Incorporated)—much like Turbo Texas Hold'em, it has computerized opponents and provides limited advice at specific decision points of the game. This program is a definite improvement on Turbo Texas Hold'em in the quantity of statistics provided, and the "weighted" advice that is given to the user, such as "In this situation you should Raise 30% of the time and Call 70% of the time". However, like Turbo Texas Hold'em, this software cannot be run in an Internet browser and does not use dynamic analysis over a series of decision points.
   c) PokerTracker (PokerTracker Software, LLC)—This software stores hand histories (transcripts of previous poker hands) for a player in a database. Users can view statistics on how much they have won or lost in particular situations, how often they were dealt particular hands, etc. Although an excellent piece of software, it differs greatly from the present invention in that it only looks at hand histories and it is up to the user to analyze the statistics presented and make inferences for themselves.

SUMMARY

In accordance with one embodiment, disclosed is a method of providing analysis of an individual's performance in a poker game, where said poker game is played in an Internet browser, comprising: providing a computer processor system; providing processor executable code allowing an end user to play a poker game against one or more opponents in an Internet browser; providing a software engine; said software engine performing an analysis of strategy for said end user; said analysis of strategy based on one or more decisions made by said end user in one or more game scenarios of said poker game; causing said analysis of strategy to be made available to said end user upon request via a storage medium or computer output device; whereby helping said end user to improve their performance at future poker games or providing entertainment for said end user.

As an example embodiment of how this whole process could be accomplished from start to finish, using elements from several different embodiments that will be described:

1. End user engages the poker game to play
2. Poker hands and computer player actions are read in from an XML file.
3. End user plays these pre-determined poker hands against these pre-determined opponents.
4. The end users actions are sent across a network to a database server.
5. The analysis engine on the database server becomes active and begins analysis.
6. The analysis engine analyzes all the end user's actions. Some it looks at individually, while some skills (e.g., bluffing) are evaluated as an entire picture over the course of all the poker hands, cross-compared with other skills.
7. These results from the analysis engine are used to produce a score or ranking, and to produce a final analysis document.

This invention can be best be understood, however, by reading the detailed specification and provided algorithms, and by the specific embodiments and the diagrams.

DESCRIPTION OF THE DRAWINGS

FIG. 3 shows a list of possible categories of poker skills, errors, and game factors.

FIG. 4 shows a method of presenting a summary analysis to an end user.

DETAILED DESCRIPTION

Scope of this Document

Figure 1:
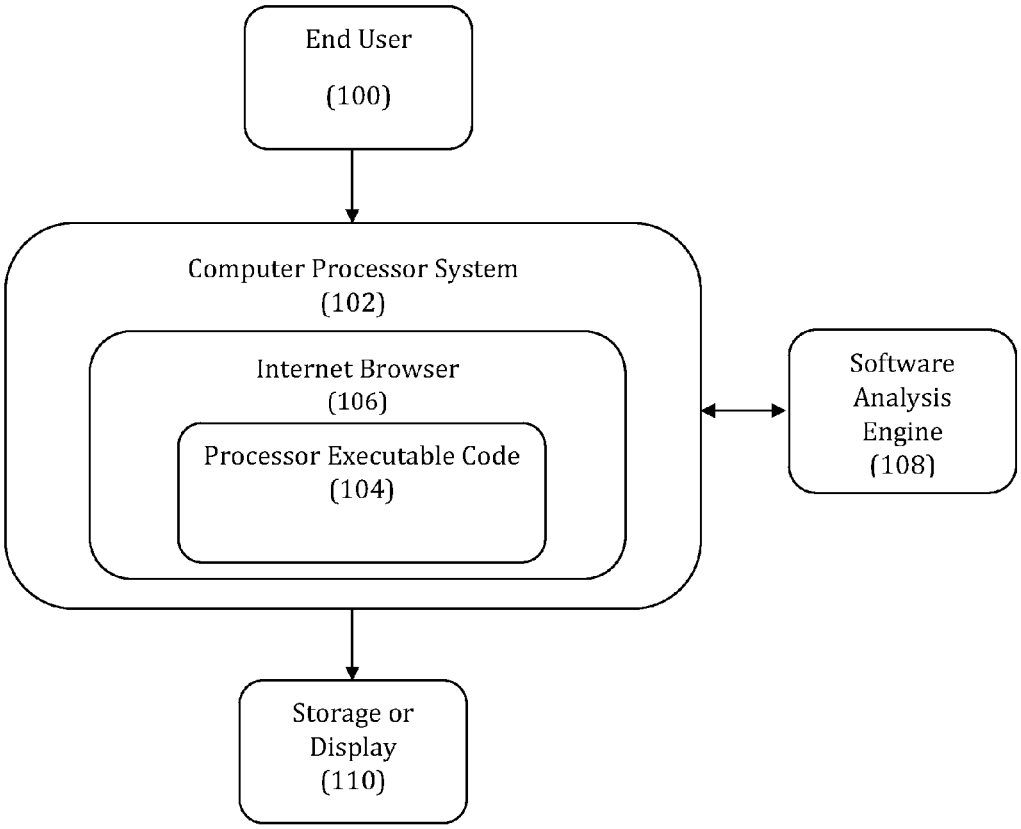
FIG. 1 shows a system for analyzing an individual's performance in a poker game.

This document cannot begin to teach everything that one needs to know about poker to build an accurate analysis engine. Many poker terms are used throughout this document.

As many as possible have been defined in the poker glossary, however, the exact meanings and implications may still be unclear to someone unfamiliar with poker strategy. For an excellent reference, the book The Theory of Poker by David Sklansky (Two Plus Two Publishing; 1994) is recommended.

Therefore, a non-poker player should not expect to read this document and immediately be able to write poker software. However, we are certain that a skilled computer programmer and a skilled poker player (either one person with both skills or a team working together) will be able to use the information contained herein to build poker analysis and training software that is far beyond any available in prior art.

Glossary

For the purposes of this document, the following terms are defined as such:

Analysis (of Strategy): An examination of many factors related to game play in a poker game. Factors can include but are not limited to: actions made by a player at decision points, reactions of opponents, hole cards and board cards dealt, strategic and tactical weapons employed, metagame considerations, and elements of randomization and luck.

Analysis Output: The presented form of an analysis of strategy in a form that is visually appealing or more easily interpretable by a human.

Artificial Intelligence (for computerized opponents)—The attempt, in processor executable code, to mimic the processes of the human brain. In the sense used in this invention, it means to make poker players in software that play poker as much like a human as possible. This could include mimicking the strengths and weaknesses of typical human players.

Computer Output Device: Any method of presenting information to the user of a computer processor system (e.g., computer monitor, touch screen, audio device).

Computer Processor System: Any electronic system having at least a) a microprocessor; b) an input mechanism such as a touch screen, keyboard, or mouse; c) an output mechanism such as a video display. Examples of computer processor systems would include but are not limited to home computers, laptop computers, and handheld devices (e.g., PDA, iPhone, Blackberry).

Computerized Opponents: Poker players that are controlled by processor executable code. In other words, once the processor executable code has been written, no human intervention is required when it comes to their ability to act and react in a poker game.

Decisions (decision points): A point in a poker hand at which an action is required of a particular player. To make a choice (e.g., bet, raise, call, check, or fold) when it is one's turn to act.

Dynamic Analysis (of Strategy): An examination of a poker session or sessions that implements algorithmic manipulation of end user decisions to provide overall, categorical, or situational analysis of an end user's poker skills. Many embodiments of the current invention use dynamic analysis, which is one of our main innovations being disclosed.

End User: The person engaging in the use of our invention and playing a poker game against one of more computerized and/or human opponents (who may in fact be end users themselves, connected in to a central server and using similar software to play at a common poker table; nevertheless, from our point of view they are "opponents").

Game Scenarios: The elements that make up one or more poker hands, such as the cards dealt, the number of players, the personalities of those players, and the number of chips each player has.

Internet Browser: Any software program for accessing content over the worldwide network known as the Internet or the "World Wide Web". Internet Explorer and Firefox are example brand names of popular Internet browsers for home computers. For the purposes of this document, the display screen of a handheld device will be considered an Internet Browser, when such handheld device can receive executable code or scripts over wide-area cellular telephone networks or standard wireless networks and can execute this code. Examples of these include the iPhone, Blackberry, and certain iPods.

Opponents: The one or more computerized and/or human adversaries or rivals to our "end user".

Performance: as it relates to poker, this is the long term results of a player's strategy. In the short term, due to the element of luck, anyone can be a winning poker player. But in the long term (possibly a year or longer), the better players will win the most money or chips (the stakes for which the game is being played).

Poker Training: The approach taken by a poker player to systematically improve one's ability to skillfully compete in the game of poker, or increase one's enjoyment of the game.

Pre-programmed Actions (for computer opponents): When computerized opponents have a set response, set by the programmer, to many possible end user actions in a poker game (as opposed to acting by artificial intelligence).

Pre-programmed (game scenarios): When the events occurring in one or more poker hands are set in advance. For example, if the same cards will always be dealt each time the game is played.

Processor Executable Code: Any machine instructions or programming language scripts that can be interpreted by a computer processor. C++, C#, PHP, JavaScript, and ActionScript are just a few examples of programming languages that can produce processor executable code when run through a compiler or interpreter. It should be noted that several different programming languages in tandem may be needed to produce the required processor executable code for a complete poker training system. For example, we might have C# or ActionScript running locally for the user interface, while communicating with a Web server that is executing PHP code for the software engine.

Random (game scenarios): When the events occurring in one of more poker hands occur in a random or pseudorandom manner. Thus, cards dealt come from a computer-simulated shuffled card deck.

Software Engine: The core functionality of a computer program. In the sense used herein we are referring to software that uses mathematical, statistical, and other means to examine poker-related decisions. This is distinct from peripheral aspects of the program, such as look and feel.

Static Analysis: An analysis of a poker action made by the end user using current state information we have available and nothing more.

Storage Medium: This can mean either an electronic hardware medium such as a hard drive, flash drive, temporary RAM device, or even an email account with allocated storage space; or a printer or other device producing a "hard copy".

Glossary

Additional Poker Terminology Used

All-In: Refers to an option to wager all of his or her remaining money or chips that may be exercised (i) by any player then participating in that hand (ii) in any of the several rounds of wagering associated with that hand.

Big Blind: A forced bet placed at the beginning of a hand, generally by the player two seats to the left of the dealer.

Bluff: An attempt by a player to represent a strong poker hand, when that player in fact has a weak poker hand. In order to represent a strong hand, the player typically makes a sizeable bet, although other techniques are possible (for example, a smaller bet could be seen as even stronger to an opponent who was overly suspicious).

Board Texture: The makeup of the community cards on the board. For example, whether there is a pair on the board, or several cards of the same suit.

Check-Raise: See sandbagging.

Community Cards: Refers to the cards that are dealt face-up and that may be used by all players then active in any given hand.

Continuation Bet: A follow-up bet made by a player who raised on a previous betting round to represent a strong hand, when the player does not in fact have a strong hand.

Draw: A hand that still requires additional cards to improve. For example, 5 suited cards are required for a "flush", so a hand with 4 suited cards is known as a Flush Draw.

The Flop: The first 3 community cards dealt in a game of Texas Hold'em poker. Also refers to the betting round that follows the display of these cards.

Fold: Refers to a declaration by a player in a hand that he has decided to withdraw from the hand and forfeit the amount he has wagered prior to his declaration.

Hand: Refers to a round of poker in which each player is dealt cards and play continues to the showdown, or the point at which only one player is left.

Hold'em: Refers to a poker variant in which community cards are shared among all the players. Rounds of wagering occur after cards are dealt and after additional community cards (sometimes as many as three at a time) are displayed, with the winner based on the highest ranking poker hand per the rules. Some popular examples include: "Texas Hold'em", described in more detail later in this document; "No-Limit", where a player can use the "all-in" option to bet all of his or her chips or money at any time without restriction; "Omaha", where each player is dealt four cards, and must use exactly two of those; "Hi/Lo", often played in conjunction with Omaha, where both the best and worst poker hand share the pot; "Tournament", which is played at increasing stakes until one player has all the chips; and "6-max", where only 6 players are allowed at the table.

Hole Cards: The cards dealt face-down to each player.

Metagame: The "game within the game"; strategies and tactics which transcend the current poker hand. For example, in a live poker game, a player may sometimes expose a poor hand to project a certain "table image" and set up later plays.

Outs: Possible chances of winning with a hand that may be currently inferior. For example, if a poker hand as 4 spades in it, it needs one more spade to make a flush. There are 9 spades remaining in the deck, so that hand is said to have "9 outs".

Pre-flop: The betting round when each player has received their hole cards but no community cards have been dealt yet.

Poker: Refers to a classification of card game in which a number of players compete against each other in hands to win the pot. The winner in each hand is determined based upon a fixed ranking of hands, and may be determined by the highest hand, the lowest hand or split between the highest and lowest hand.

Poker Game: A session of poker, comprising one of more hands of poker.

Poker Hand: A combined set of playing cards that can be compared to another combined set of playing cards based on an agreed upon ranking system.

The Pot: Refers to the sum total of all wagers placed by all players. The player with the best poker hand at the end of play wins all the chips (or money) in the pot, minus any amount taken by the game host.

The River: The final community card dealt in Texas Hold'em poker. Also refers to the betting round that follows the display of this card.

Sandbagging: To check a strong hand with the intention of raising or re-raising any bets. Also known as a check-raise.

Semi-bluff: When a player makes a bet with a hand that is currently weak but has the potential to become a very strong hand on a later round. A common example is when someone has a flush draw and makes a bet into the pot. The bettor hopes that the other players will fold, and he will win the pot right there, but if not the next card may complete his flush.

Showdown: The end of a hand of poker where all remaining players have to show their cards, and the winner is declared (the player with the highest ranking poker hand per the rules of the particular poker variant).

Slowplaying: An act of deception in which a player does not bet a very strong hand until a later betting round.

Small Blind: A forced bet, usually ½ the size of the big blind, placed at the beginning of a hand, generally by the player one seat to the left of the dealer.

Stack Size The amount of money or poker chips a player has with which to wager.

Table Image: The way a player is perceived by his or her opponents, in terms of what style of poker and what tactics they think he or she will use.

The Turn: The next community card dealt after the flop in Texas Hold'em poker. Also refers to the betting round that follows the display of this card.

DETAILED DESCRIPTION OF THE DIAGRAMS

FIG. 1 shows a system for analyzing an individual's performance in a poker game. An End User 100 plays a poker game on a Computer Processor System 102 (such as a desktop computer). The poker game is played in an Internet Browser 106 (it should be noted, however, that an alternate method disclosed herein of providing dynamic analysis of an individual's performance in a poker game does not require an Internet browser). Processor Executable Code 104, written in a language that supports running in an Internet Browser (e.g., Flash Actionscript, JavaScript, ASP.NET, PHP), executes in the Internet Browser (and ultimately on the Computer Processor System 102 or partially over the Internet on a Web server). When the End User 100 makes a poker-related decision, a Software Analysis Engine 108, which may or may not be located on a different computer system, analyzes the player's strategy and makes observations and recommendations, via a Storage or Display 110, when requested by the user. These observations and recommendations may be from both static analysis and/or dynamic analysis as defined in this document.

Figure 2:
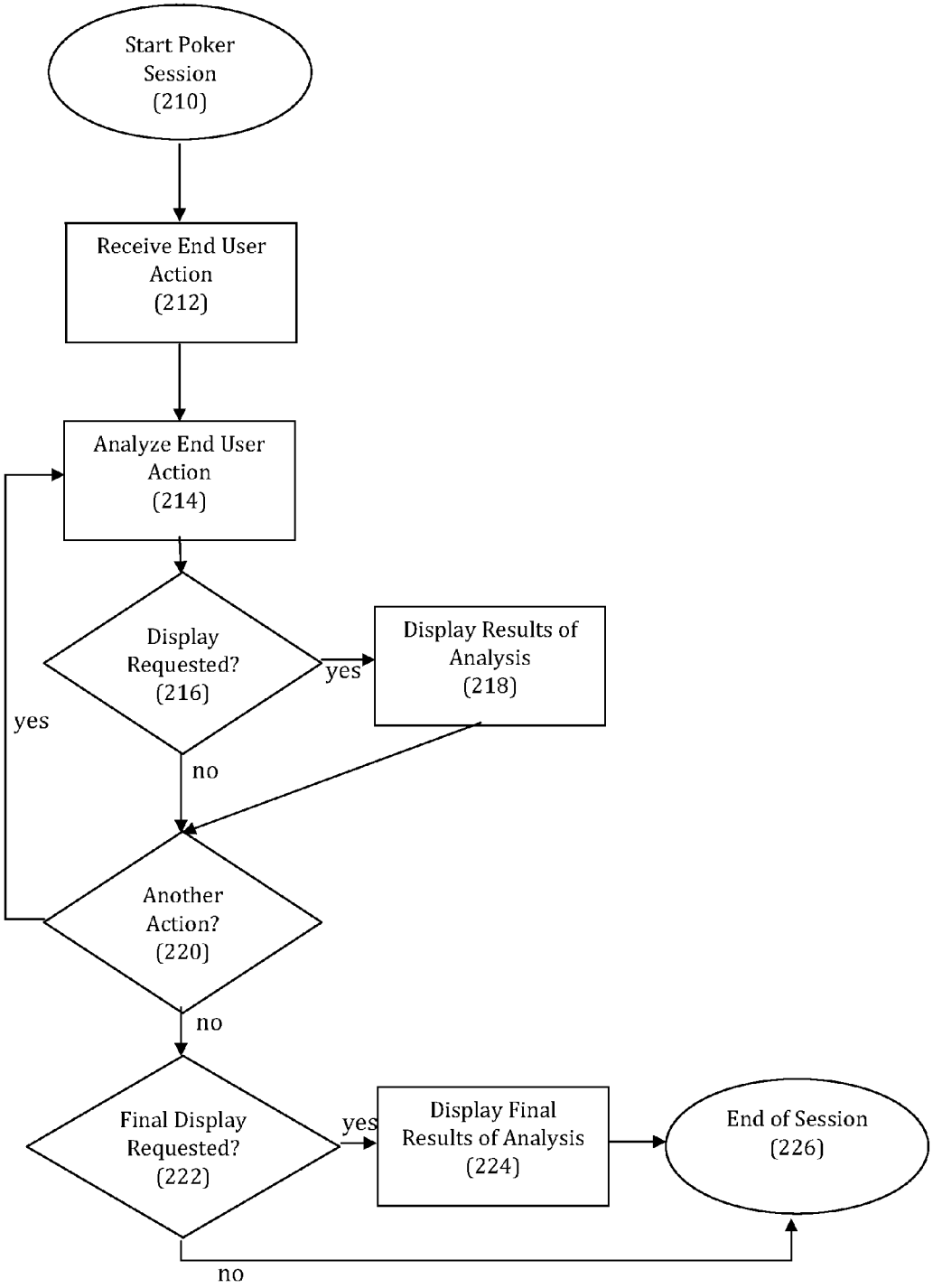
FIG. 2 shows a basic view of a poker analysis method.

FIG. 2 shows the most basic view of a poker analysis method. An end user engages in a poker game session 210. Although there will be many other actions taking place by the other players, at some point it is time for the end user to make a poker related action 212 (such as bet, check, or fold). This action is analyzed 214 by an analysis engine, either against static criteria or, in some embodiments, by dynamic analysis (multi-level analysis, "running" analysis). The user is asked whether they would like their analysis displayed now 216. If so, we display their current analysis 218. Otherwise, we wait for the next end user poker-related action 220. Once there are no more (the poker session is over), we ask the user if they would like to see their final analysis 222. If so, we display it 224, if not the session is over 226.

Texas Hold'em Poker

Although the invention is not limited as such, in this document we will be using one of the most popular poker games for our examples. The game is "Texas Hold'em" poker, a game which, like other poker games, awards a pot to the player having the highest five-card poker hand, ranked in standard poker fashion, i.e. royal flush, straight flush, four of a kind, full house, flush, straight, three of a kind, two pair, one pair, and high card, in descending order. Texas Hold'em is played sequentially through nine separate steps, as follows:

1. two cards are dealt, face down, to each player;
2. a round of wagering occurs, often with two forced wagers from the two players to the immediate left of the dealer (known as the small blind and big blind).
3. three community cards are dealt, face up (known as the flop);
4. a round of wagering occurs. It should be noted that a player is entitled to check, rather than wager; however, if a player checks and another player wagers, the player who checked must match the wager, raise the wager or fold;
5. the next-to-last "community" card is dealt, face up (known at the turn card);
6. a round of wagering occurs;
7. the last community card is dealt, face up (known as the river card);
8. a round of wagering occurs; and
9. each remaining player exposes his down cards, the winner is declared and the pot is distributed.

Poker Training and Analysis

Poker training and analysis is the subject of the current invention. Although poker has elements of luck, there is great skill in making correct decisions. This invention makes vast improvements in training and analysis for poker. Some embodiments can be played in an Internet browser, which is a significant improvement from a user's point of view. In some embodiments we move beyond monolithic poker training programs that only consider each action of the poker player individually—which is of limited use to the player because poker is a game of many actions that all contribute to a final result.

Scope and Ramifications of the Invention

As mentioned previously, some embodiments of this invention can be played in an Internet Browser. This provides a distinct advantage over standard software (that cannot be run in an Internet browser), especially for laptop and desktop users, because the software can be started with "no download required". Although technically downloaded to the user's computer, in Internet parlance software is known as "no download required" if the software that can be executed on a computer system without going through an operating system install process. For users, there are two advantages. First, the software starts almost instantaneously without going through a complicated install process. Second, installing software on one's machine exposes that machine to additional threats of viruses, spyware, and other malware. From a business standpoint, the advantage is obvious: many more users will be willing to use the software. Examples of "no download required" software includes Javascript applications (such as Google Maps), Adobe Flash applications (used by YouTube.com), and iPhone applications.

Some embodiments provide dynamic analysis of a player's poker game, which is when decisions are not evaluated in a vacuum but are evaluated as a whole picture, including cross-analyzing the combined effects of different strategic poker decisions.

That is not to say that evaluation of play on individual decision points is completely worthless. As an example, the two card Hold'em Poker hand seven-deuce (a 7 and a 2) is the worst possible hand one could be dealt. Playing this hand (placing a wager with it) is almost certainly an error in any situation. In the branch of mathematics known as game theory, playing 7-2 would be known as a "dominated strategy".

But, to completely understand poker and be able to give complete and correct advice to a player, one must understand that poker is played on many levels. In game theory it would be known as a "repeated game of incomplete information"—a repeated game, in the sense that each individual poker hand is a game in and of itself, and a game of incomplete information, because of the hidden hole cards. Games of incomplete information are much more difficult to analyze, from a computer's standpoint, than games of complete information such as checkers or chess.

As for the ramifications of this invention, poker players everywhere (who number in the millions) will be able to receive a much more complete analysis of their strengths and weaknesses, to improve their game and increase their enjoyment of the game. As one indicator of the value of the invention to the poker playing community, the authors are already marketing one embodiment of the current invention and it is achieving good commercial success.

Types of Analysis

Before going over the specifics of the current invention, it is important that we explain more about the basics of poker player evaluation. We need to discuss in detail the differences between what we will term "static analysis" and the more complicated "dynamic analysis".

Static Analysis

The is the simplest form of analysis, although far from trivial. We simply determine what plays are clearly an error, based on the current state of the poker hand. The previous example of playing the hand 7-2 is this type of error, and would easily be caught by software accomplishing static analysis. An additional example would be folding the hand A-A (a pair of Aces, the best possible hand) pre-flop. While these are extreme examples, most decisions are not so simple. Current prior art software uses massive lookup tables or static "rules" to spot the more complicated types of errors. An example of a complicated rule would be "If the player calls a bet, and that bet is more than ⅓ the size of the pot, and there are other opponents still to act after the player, and the player has only a flush draw, this is an error". As you can see, it can get quite complex, but it is still only static analysis.

Digressing a bit—when building poker software, even for "static analysis", how do we actually decide what is a "good play" versus a "bad play"? This will be discussed more below, but there are at least two elements to this determination. The first is mathematics, most especially simple percentages and odds, which have been analyzed by computers for decades now, and the results are well known to advanced players. For example, when a player needs one more card to make a "flush" (a powerful poker hand), the odds of making that flush on the next card are about 4 to 1 against. Known odds like these can help us determine the correct plays.

The second element to determining "good plays" versus "bad plays" is advice from professionals. Poker, especially No-Limit Holdem, is such a complex game, that we seek the advice of top poker players in determining the best plays in given situations for our static analysis engine. Results speak for themselves and therefore the opinions of top players can correctly indicate the right plays.

Dynamic Analysis

Previously we talked about how playing the hand 7-2 is a clear error. We also discussed more complex examples of static analysis at a given decision point. Dynamic analysis goes far beyond this, looking at many different factors over the entire course of a poker session or sessions. As a specific example, consider the value of a "bluff" in poker, which means to attempt to make your opponents believe you have a winning poker hand, when in fact you may have a poker hand that cannot possibly win. Bluffing is a key aspect of poker. Evaluated individually, it is difficult to determine whether a bluff in a particular situation is the best play or not. However, over the course of time, we can use game theory to determine the proper amount of bluffing. Game theory dictates that bluffing too much or too little is a critical error. It should be quite obvious, that if you played 50 hands of poker against the same opponents, and bluffed on every single hand, that your opponents would catch on and eventually punish you for this action, even though each individual bluff may not be an error in and of itself.

Without going into lengthy discussion of game theory as it relates to poker, we can give one example. Suppose there is a decision point at which a bluff is indicated (which is certainly not all decision points; often bluffing would be an outright error). Given we have a single opponent, and a poker hand that cannot possibly win, how often should we bluff, if there are 100 chips in the pot, and we plan to make a bluff bet of 50 chips? The correct answer based on game theory is 1 out of 4 times. In other words, 3 out of 4 times, we should make a similar bet in a similar situation when we actually have a legitimate hand (not a bluff). The reason is that only at this frequency is the opponent unable to defeat us in the long run, regardless of what strategy he or she uses:

$$(3/4)\times(-50)+(1/4)\times(+150)=0$$

3 out of 4 times we are not bluffing, and our opponent loses an additional 50 chips. One out of 4 times we are bluffing, and our opponent wins 150 chips. In the long run, our opponent can only break even, regardless of their strategy.

This is why we need dynamic analysis. Because each bluff is not in and of itself correct or incorrect, we have to weigh all the bluffs over a session of poker to see if the correct balance was used. (A complete discussion of game theory would be beyond the scope of this document, but we should at least note that occasionally, a skilled player will deviate from game theory in an attempt to capitalize on a specific weakness of one of his or her opponents. Such a recommendation in a player's analysis output would not be beyond the scope of the current invention.)

To add to the complexity, even the skills and tactics themselves must be cross-compared because they can interact with each other. For example, there are many plays known to the experienced poker player (see glossary), such as "slowplaying", "sandbagging/check-raising", "continuation betting", "semi-bluffing", and more. Slowplaying and sandbagging could be informally categorized as "trickery", while "continuation betting" and "semi-bluffing" would fall under the category of "representing a hand one does not have" (though they are distinguishable from an all out bluff). While all this may be confusing to the non-poker player, the fact of the matter is this: the more a player is suspected of using devious tactics, the less effective their bluffs will be. Other players will be suspicious of them and will likely call their bluff. Professional poker players know this well, and are always re-assessing what is known as their "table image" in determining the correct play.

So therefore, when evaluating the correct amount of bluffing, a poker training program has to look not only at each individual bluff, and not only at all the bluffs over all the poker hands played, but at all the bluffs in the context of how they interact with other skills areas. We analyze all hands as a whole, and cross-reference all skills and actions to determine interactions between these skills and actions that might affect optimal play.

It should be noted that only static analysis has been accomplished in prior art. Static analysis only analyzes the current decision point, and bases the advice given on current game factors such as the pot size, stack sizes, and action in the hand up to the decision point. But to accomplish dynamic analysis, we need methods which are disclosed in the current invention.

Furthermore, even static analysis has not been accomplished in an Internet Browser "no download required" version in prior art. The difficulty of accomplishing this task stems from the limited system resources available to a program running inside an Internet browser. This includes limited access to the hard drive and much slower scripting programming languages. Poker analysis is extremely mathematically intensive. To demonstrate the difficulty involved, the inventors wrote a mathematically intensive test program and ran it in two programming languages: ActionScript (which runs in an Internet Browser) and C# (which does not run in an Internet Browser). The ActionScript program took over 100 times longer to execute. It is quite obvious that to do poker player evaluation in an Internet Browser, new algorithms must be developed; these are disclosed in this document.

To sum up, to evaluate one's skill at poker, few actions can be taken in a vacuum. Only the sum total of all actions over the course of a poker session determine good versus bad play. And even then, the interaction among the strategies and tactics must be taken into account.

Algorithms

In the spirit of complete disclosure, it is important that we present pseudocode representations of the special algorithms needed to make the embodiments of this invention a reality. We will take a high-level look at the methodologies; with this information it will be clear to one skilled in the art how to realize the finished product by using well known software routines, data structures, and programming languages.

Algorithms for Static Analysis

The most simple method for accomplishing static analysis is to have lookup tables for the known right/wrong actions, and rules about when to apply them, as shown below:

```
int i=0;
foreach(gameParameter in gameParametersArray)
{
   state[i++] = Evaluate(gameParameter.type,
                         gameParameter.value);
}
handStrength = LookupStrength[state[0]][state[1]] . . . [state[n]];
if (handStrength > BET_THRESHOLD)
   action = BET_OR_RAISE;
else if (handStrength > CALL_THRESHOLD)
   action = CHECK_OR_CALL;
else
   action = CHECK_OR_FOLD;
```

Examples of game parameters are the size of the pot, the number of players still in the hand, the bet size being faced, the ranking of our hand, and the board texture (the makeup of the community cards on the board). For each game parameter we use an Evaluate( ) function to assign a discrete state number that tells us something about the best decision (i.e., one piece of a puzzle).

For example, let's take the game parameter "bet size being faced". We might say in the Evaluate( )function:

If the bet size being faced is less than ½ the pot size, assign a value 1.

If the bet size being faced is between ½ and 1 times the pot size, assign a value 2.

If the bet size being faced is greater than the pot size, assign a value 3.

In this way we encapsulate the parameters in distinct groupings, so that we can use a lookup table. Once we've done this for all game parameters, we use the LookupStrength table to determine our hand strength. The Evaluate( ) function and contents of the LookupStrength table might be based on statistics, or recommendations from skilled poker players (the actual implementation of these is not the subject of this invention).

Rule-based analysis works wonderfully pre-flop. There are many shortcomings of using rule-based analysis, however, especially on the later betting rounds when the game state becomes more complex and any rule-based table would have to be many-dimensional and prohibitively large. An additional method tried in this case, to eliminate the lookup table, is to start with a maximum point value for a hand and subtract penalties for various game parameters, as shown here:

```
int totalPoints=100;
foreach(gameParameter in gameParametersArray)
{
   totalPoints -= Penalty(gameParameter.type,
                          gameParameter.value);
}
if (totalPoints > BET_THRESHOLD)
   action = BET_OR_RAISE;
else if (totalPoints > CALL_THRESHOLD)
   action = CHECK_OR_CALL;
else
   action = CHECK_OR_FOLD;
```

For example, for the "number of opponents" game parameter, we might subtract 5 points for each additional opponent remaining after the flop, since our odds of winning are certainly decreased the more opponents we have.

This too has its shortcomings, because the correct values for the penalties to subtract are tough to arrive at, even for skilled players. In complex situations, the totalPoints at the end is rarely a reliable indicator of the actual strength of the poker hand. Several commercial poker training programs use a method similar to this and the advice given is incorrect in many situations. Therefore, on the later betting rounds, a technique the authors have used to indicate the best decision is to exhaustively analyze all possible outcomes from that point forward, and see how often our hand will be the best hand:

```
int winCount = 0;
int loseCount = 0;
Hand ourPokerHand;
foreach(remainingCommunityCard)
{
   foreach(CardRemainingInDeck in cardsArray)
   {
      foreach(opponentHand in allPossibleOpponentsHandsArray)
      {
         bool weWin = DetermineWinner(opponentHand,
                                      ourPokerHand);
         if (weWin) winCount++;
            else loseCount++;
      }
   }
}
DetermineAction(winCount, loseCount);
```

This too has its limitations, since we have a huge amount of mathematical computations. The DetermineWinner( ) function must be run 1,070,190 times for one opponent on the flop! (This number comes from 47 unknown cards and 2 community cards and 2 opponent's cards of which to enumerate all possibilities). And DetermineWinner( ) is not a simple function—it must be able to compare two poker hands to determine the winner (a non-trivial task; although many free implementations with source code exist on the Internet). While some computer processors can handle the computation under optimal conditions, it is prohibitively slow when the code is run in an Internet Browser. Some embodiments of the current invention require running in an Internet Browser. That is why the following algorithm had to be developed by the inventors especially for this purpose:

```
function FastDetermineBestAction
{
   Hand ourHand;
   Array strengths=SetStartingHandStrengths( )
   Sort(strengths on Object.strength);
   pointsToGive=MAXIMUM_POINTS;
   for (opponent in totalOpponents)
   {
   pointsToGive−=MatchupAgainstWeightedRange(our-
Hand,
   opponent.range, opponent.weight, strengths);
   if (pointsToGive<0) break;
}
if (pointsToGive<0)
{
   if (SemiBluff(ourHand))
   action=BET_RAISE;
   else if (ContinuationBet(ourHand))
   action=BET_RAISE;
   else
   action=CHECK_FOLD;
}
if
(pointsToGive*RAISE_FACTOR<MAXIMUM_POINTS)
{
   action=CHECK CALL;
}
else
{
   action=BET_RAISE;
}
}
function SetStartingHandStrengths( )
{
   int i=0;
   Array strengths;
   foreach (hand in possibleHoleCards)
   {
   value=HandVal(hand);
   outs=HandOuts(hand);
   strength=value+(1−value)*outs;
   strengths[i++]=Object(hand, strength)
   }
   return strengths;
}
```

Some explanatory notes:

1) SetStartingHandStrengths( ) prepares an array of every possible starting hand (1,176 in Texas Hold'em after the flop has been displayed). The current hand value from HandVal( ) is given as a percentage of hands that this hand could beat if we did a showdown right now without revealing any more cards. The outs from HandOuts( ) is a percentage of time this hand will improve to a flush or straight on the next betting round. Functions like HandVal( ) and HandOuts( ) are freely available in the open source code community, so code will not be given here. The strength is given as a function of value and outs.
2) We start with a maximum number of points (held in the variable pointsToGive), and for each opponent we match up against them based on a) our hand, b) their possible range of hole cards (which can be estimated based on their action pre-flop and up to this point), and c) the "weight" of this opponent (an opponent who has been betting or raising might be treated as more critical and would receive a higher weight). The Strengths array is used in conjunction with opponent.range to determine the percentage of hands in the opponent's range that are currently ahead of us in "strength". MatchupAgainstWeightedRange( ) returns the number of points we should "lose" to this opponent based on this factor. The relative values and scale of pointsToGive and the value returned from MatchupAgainstWeightedRange( ) are up to the programmer and poker expert. The inventors have used the following values:
   a. a value of (0.25×totalOpponents.count) for pointsToGive,
   b. have MatchupAgainstWeightedRange( ) return the estimated percentage of poker hands in the opponent's range that the end user is behind, times the weight of that opponent (defaults to 1).
3) Functions like SemiBluff( ) and ContinuationBet( ) are included to show that if we run out of points, all is not lost. We might still choose to make a semi-bluff with a hand that has a large number of outs. We might make a continuation bet if we were the aggressive player pre-flop. Other strategic moves could be considered here as well.
4) RAISE_FACTOR determines how often we will raise. For example, if RAISE_FACTOR was 2, then if we use up less than ½ our points we will bet or raise, otherwise we check or call.

This algorithm gives a very good estimate of the relative strength of a player's poker hand in a reasonable amount of processor time, which is critical for an embodiment that includes running in an Internet Browser. Although the analysis is not quite as good as the exhaustive analysis of the previous example, it is several orders of magnitude faster; requires a maximum of 2,352 hand evaluations as opposed to 1,070,190 on the flop. (This algorithm is to be used on the flop and beyond; it is still best to use a lookup table pre-flop).

Algorithms for Dynamic Analysis

Although never realized in prior art, dynamic analysis, from the processor's point of view, is actually computationally easier than a full-scale static analysis. The following general algorithm can be used (shown in detail for one specific skill, bluffing):

```
Hand ourHand; // contains the cards in our hand
Action ourAction; // tells what the last action we took was
PokerGame game; // context information about the poker game
SkillScoreArray scoreArray; // has scores for various skills
foreach (skill in SkillsArray)
{
   EvaluateSkill(skill, scoreArray[skill], ourHand, ourAction,
                game);
}
function EvaluateSkill(skill, score, ourHand, ourAction, game)
{
   if (skill == BLUFFING and ourAction.type == BET_RAISE)
   {
      int handStrength = HandStrength(ourHand);
      float correctBluffPercentage = 1 / ((game.potSize /
            ourAction.betSize) + 1);
      if (handStrength < BluffThreshold(game))
      {
         ComputeRunningBluffTotal(correctBluffPercentage,
                                  TRUE);
      }
```

-continued

```
    else (handStrength < BadHandThreshold(game))
    {
        // This is too good of a hand to bluff with
        score.badBluffs += game.situation.weight;
        ComputeRunningBluffTotal(correctBluffPercentage,
                                 TRUE);
    }
    else
    {
      // We assume this was most likely not a bluff (that
      // is, the player believed they had a strong hand)
        ComputeRunningBluffTotal(correctBluffPercentage,
                                 FALSE);
    }
  }
  // . . . additional skills go here
}
function ComputeRunningBluffTotal(correctBluffPercentage,
                                  didTheyBluff)
{
  if (didTheyBluff == TRUE)
  {
    m_bluffs++;
  }
  m_correctBluffPercentage += correctBluffPercentage;
}
```

The code could be called at every decision point to continually reassess the player's performance. At any given time the user can look at their current performance and areas needing improvement.

Some additional explanatory notes about the source code:

1) SkillsArray contains a list of all the skills for which we are testing.
2) handStrength is the same 'strength' as defined in the previous code snippet in SetStartingHandStrengths( )
3) correctBluffPercentage is computed from a formula that will be familiar to those knowledgeable in game theory (the pot size given already includes our bet).
4) BluffThreshold( ) is a function that tells us whether our hand was poor enough to dictate a bluff possibility. Game Theory indicates that we should only bluff with our very worst hands, not medium-strength hands. This function could be as simple as choosing the bottom 10% of hands, or something more complicated based on the correctBluffPercentage.
5) BadHandThreshold( ) indicates the percentage of hands below which we are relatively sure that the player intended their bet to be a bluff. In this case however, it was a bad time to bluff, because they were over the bluff threshold, so they get a deduction.
6) We add 1 to m_bluffs every time they bluff. Every time they bet, regardless of whether it is a bluff or not, we always add the correct bluff percentage to m_correctBluffPercentage.

After a long poker session, it is clear how m_bluffs and m_correctBluffPercentage would be very useful. Suppose the end user had bet four times during a session, and only one of those was a bluff (therefore, m_bluffs would be 1). If the correct bluff percentage was 25% in all those cases, m_correctBluffPercentage would be (0.25+0.25+0.25+0.25=1). To sum up, the total of the correct bluff percentages should add up to the total number of bluffs by game theory. If m_bluffs is significantly greater, they have bluffed too much. If m_bluffs is significantly lower, they haven't bluffed enough.

Similar algorithms could be used for other skills and game factors including but not limited to those shown in FIG. 3. By using this method, we can provide the user with a substantially more detailed and useful analysis of their poker skills. We are no longer limited to rules-based advice at a particular decision point, or pure statistics which are left to the user to interpret.

The crux of the issue when it comes to dynamic analysis is to determine the proper weightings and interactions between the various metagame strategies and deceptive techniques used by the poker player. To understand this, the following sample algorithm is presented:

```
function EvaluateSkillsInteraction(game)
{
  //Skill Interaction Example A
  m_bluffOverage=m_bluffs-m_correctBluffPercentage;
  m_SlowplayOverage=m_slowplays–
  m_correctSlowplayPercentage;
  m_CheckRaiseOverage=m_checkRaises–
  m_correctCheckRaisePercentage;
  m_ContinuationBetOverage=m_continuationBets–
  m_correctContinuationBetPercentage;
  m_SemiBluffOverage=msemiBluffs–
  m_correctsemiBluffPercentage;
  m_deceptiveBalanceScore=m_bluffOverage+m_Slow-
playOverage
  +m_CheckRaiseOverage+m_ContinuationBetOverage+
    m_SemiBluffOverage;
  if        (m_deceptiveBalanceScore>DeceptionThreshold
(game))
  alert(WARNING_TOO_DECEPTIVE_OVERALL);
  //Skill Interaction Example B
  m_chipsWonOrLost=game.currentChips–game.starting-
Chips;
  if (m_chipsWonOrLost<–(5*game.totalHands))
  {
  if        (m_deceptiveBalanceScore>DeceptionThreshold
    (game)–
    LosingAdjustmentFactor(m_chipsWonOrLost))
      alert(WARNING_TOO_DECEPTIVE_GIVEN-
        _LOSING);
  }
  //Skill Interaction Example C
  float averageBetSize=0.0;
  int totalBets=0;
  foreach (bet in game.betsMade)
  {
  if (bet.bluff==FALSE)
  {
    averageBetSize+=bet.amount/bet.potsize;
    totalBets++;
  }
  }
  averageBetSize/=totalBets;
  if (m_bluffs/2>TypicalNumBluffs(game.totalHands))
  {
  if (averageBetSize<0.75)
  {
    alert(WARNING BETSIZE TOO SMALL GIVEN
      TABLE IMAGE);
  }
  }
}
```

In the code segment above we demonstrate three possible skills interactions given a current game state. In Skill Interaction Example A we look at the current amount of bluffing, slowplaying, check-raising, continuation betting, and semi-bluffing the player has been doing. The Overage values can be positive or negative. When added up, they should ideally be as close to zero as possible, since all the skills interact with each other in the sense that they are all deceptive plays. To put it another way, once a player is labeled as one who bluffs too much, that player should cut back on all sorts of deception, not just bluffing.

Skill Interaction Example B is an interesting one that is overlooked by many beginning and intermediate players. Experienced players know that when one is losing in a poker session, they need to play much more straightforwardly until they start winning again. Although impossible to mathematically justify, it is a known psychological regularity of the game that other players tend to expect more deceptive play from a losing player. Bluffs are picked off and check-raises are often unsuccessful. Therefore, we alert the player if they are playing deceptively when they have been losing (in the example shown, the threshold is an average of more than 5 chips per hand).

Skill Interaction Example C is another skill well known to expert poker players. Sometimes, by random variance, one will find themselves in a situation where they have bluffed many times recently. This happens even when one is playing optimally (just by random streaks). Other players will take note of this and will be suspicious. To take advantage of this, it is important that one bet larger amounts with their legitimate hands. In the example code shown, we check to see if we have been bluffing more than double the normal amount. If so, our average bet size with a legitimate hand should be at least, say, 75% of the pot, whereas in a normal situation perhaps anything over 50% would be acceptable.

These are only 3 examples of skills interactions for which a test can be developed. The purpose of this document is not to enumerate all possible interactions, but to give examples of the methodologies used. A skilled poker player could produce a list of possibly 100s of interactions just between the skills in FIG. 3, and a person skilled in the art of programming should have no trouble translating these to source code.

In summary, we looked first at static analysis of individual decisions taken in a vacuum, at every decision point. What we found is that this barely scratches the surface of the intricacies of the game of poker. Any analysis given in this way will be incomplete, and sometimes inaccurate. To truly give proper advice, dynamic analysis is needed. Dynamic Analysis of a poker game involves keeping track of many actions, at many decision points. It involves tracking skills demonstrated and techniques utilized, and determine the right balance of when and how often to use those techniques. And finally, it even compares the interactions between the various factors and tactics used, to determine an overall balance. Through this invention, poker analysis has reached a point where a player can receive a complete picture of their strengths and weaknesses in the long run.

Conclusion

Methods of evaluating poker skills have been around almost since poker was invented. Although not available in a version that runs in an Internet Browser, computerized methods have been developed. These methods focus on individual actions of poker players in certain situations. Poker is a fluid game, however, and no action takes place in a vacuum. Individual tactics must be weighted and compared, and only then is it possible to look at the optimal long-term strategy to be a successful poker player.

While our above description contains many specificities, these should not be construed as limitations on the scope of the invention, but rather as examples of possible embodiments thereof. Many other variations are possible, and the appended claims denote the true scope of this invention.

Embodiments

It should be noted that when some elements of the current invention are already well known in prior art, and when such an element is arrived at it will not be described in great detail herein. We will not teach, for example, how to display a graphical representation of a playing card on a computer monitor, for this is a trivial task for a skilled programmer. It is natural in today's age of the Internet to have an embodiment of this invention that is Web-based and accessible all over the world. It is well known to those skilled in the art how to provide a computer program that shows an online representation of a poker table and allows and end user to interact with it. Furthermore, much open source (free) poker source code exists on the Internet to help get one started with a basic poker game.

In one embodiment, an end user has a computer processor system such as a laptop computer, which is connected to the Internet. A program is made available to the end user (for example, an Adobe Flash application that is run when the user visits a web page). The program contains processor execute code to play a poker game in the user's Internet browser. The game's user interface is much like those that are commercially available. This would typically include displaying, on a computer monitor, a graphical representation of a poker table, with players sitting around the table. When finished playing, or at some point during the game, the user requests his or her analysis of strategy, possibly by clicking a button. The request is transferred to a software engine that performs the analysis of strategy (this software engine might be on the local machine or across a network). This analysis of strategy is based on the decisions made by the end user during the poker game. When the analysis is complete, the analysis is made available to the user, for example by displaying it on their computer monitor (a summary analysis is shown in FIG. 4).

In another embodiment of the current invention, the end user engages a software poker game. The poker game runs in an Internet Browser so as to be a "no download required" game, which is very appealing to the end user. The players, known as "avatars" in the gaming community, are graphical representations of other actual players, who are human and are connected in to the game server via a network (there is a central game server that links everyone together, deals random cards, and alerts each player when it is their turn to act). There could be one or more opponents. Also displayed on the game screen are the amounts of money or chips each player has, any board cards that have been dealt (opponent's cards are shown face down until revealed at the showdown), and any other status information. Furthermore there are buttons for the end user to make poker-related actions such as raising, calling, and folding. Since the user interface for such a game is well known in prior art, it will not be described in further detail here.

Continuing with this embodiment, our end user begins a poker game, and at each decision point they are presented with advice as to the recommended action—such as bet, raise, fold, call, or check. For this, we could use an embodiment of the function FastDetermineBestAction( ) which was revealed previously. The end user can continue to play the game as long as he or she desires, or as long as there are opponents available. Each time it is their turn to act, they are given advice on the best action to take. This recommendation is arrived at via static analysis.

In a variation on this embodiment, the computer processor system is not connected to the Internet or any central server, and all game control functionality (such as the determining of cards, and actions of the opponents) occurs locally.

In yet another embodiment, the software does not deal random cards but instead deals pre-prepared hands stored in a database or widely-used file format called XML. Furthermore, the opponents in the poker game are not all human opponents, some might be "robots" who are controlled by pre-programmed rules. In this way, the programmer can prepare pre-written test hands to test certain skills. An example XML hand is shown here:

```
<hand>
  <gametype>1</gametype>
  <numberofplayers>3</numberofplayers>
  <bilttonposition>2</buttonposition>
  <communitycards>Kd 8c Th Jc Qd</communitycards>
  <bigblind>10</bigblind>
  <showdownwinner>2</showdownwinner>
  <human>
  <cards>Kh 3s</cards>
  </human>
  <opponent>
  <name>Bill</name>
  <cards>8s 8d</cards>
  <pfactions>201 5</pfactions>
  <flopactions>201 18 202 18 203 18 204 18</flopactions>
  <turnactions>201 14 202 14 203 14</turnactions>
  <riveractions>201 17 202 16 203 16</riveractions>
  </opponent>
  <opponent>
  <name>Joe</name>
  <cards>Ad Js</cards>
  <pfactions>202 4</pfactions>
  <flopactions>202 16 203 16</flopactions>
  <turnactions>203 16</turnactions>
  <riveractions>201 14 202 14</riveractions>
  </opponent>
</hand>
```

This format looks confusing at first but to one skilled in XML it is quite straightforward. Each "tag" as they are called indicates one parameter of a poker hand. For example, "<numberofplayers>" tells us that there are 3 players in this hand. Playing cards are listed in a shorthand format, e.g., 'Kd' means the king of diamonds. We can see that in this hand, based on the cards dealt, that the human player will make one pair, Bill will make three of a kind, and Joe will win with a straight. The numeric codes translate to player actions and reactions. Notice that all the actions of the computerized players (inside the <opponent>tag) are pre-determined, i.e. 201, 202, 203, and 204 are codes for the state of the game when the action gets to that player. 201 might mean "the action gets to me and no one has bet" and 202 might mean "the action gets to me and there is a bet of ½ the pot size or less", etc. The next number after the 201, 202, 203, or 204 code is an action number, which tells the player how to react, i.e. "raise ½ the pot size" or "fold". The actual codes are not important, what is important is that any similar technique could be used by a skilled programmer to write a complete suite of pre-programmed poker hands and opponents.

In a variation on this embodiment, the game scenarios are pre-programmed, but all the opponents are actually human players or computerized opponents which use artificial intelligence as opposed to those in the XML above which use pre-programmed rules.

In another variation on this embodiment, the game scenarios are random, and the opponents are computerized opponents that use artificial intelligence only.

In yet another variation on this embodiment, the game scenarios are random, but the opponents are comprised of one or more human opponents and zero of more computerized opponents that use artificial intelligence.

In another embodiment, each of the computerized opponents is given a displayed name that indicates their style of poker play. Part of correct poker skill is adjusting one's play according to the style of opponent one is up against. In the case of pre-programmed opponents, we might write specific rules to give them a particular style of play, such as too aggressive or one who plays too many hands. In the case of artificially intelligent opponents, we might make them purposefully make the wrong decision from time to time, in a way consistent with their displayed name. For example, "Aggressive Allen" might raise in situations where he should have folded.

A logical question arises here of how to create artificially intelligent computerized poker players. In one embodiment, we use the same static analysis from the software engine that we would give to the end user. In other words, we determine what advice we would give the end user if he or she were in that situation, and we base the computer player's action on that advice (excepting that we might modify it from time to time to give an opponent a particular personality).

In yet another embodiment, each of the computerized opponents and the end user starts each poker hand with a pre-determined number of chips.

In yet another embodiment, the next poker hand starts instantaneously after the end user clicks the button to "Fold" their poker hand. This is atypical for a poker game (usually one has to watch the rest of each hand even after folding) and therefore this speeds up game play and is desirable to some end users.

In another embodiment, the poker game played is the specific variant known as "Hold'em" poker. In yet another embodiment, the poker game played is of the "No-Limit" variety. Therefore in the user interface, there is the addition of a slider control for determining the amount to bet.

In another embodiment, the analysis of strategy provided does not stop at the static analysis provided at specific decision points, but it also includes "dynamic analysis" to examine the end user's long term strengths and weaknesses. This embodiment may or may not be run in an Internet Browser in a "no download required" format. In this embodiment, the end user can receive a detailed analysis of past performance at the end of the poker session, to help them improve their game. This analysis might include specific errors made, or a score in various categories related to poker skills, such as the analysis summary shown in FIG. 4.

In another embodiment, the scores in the various categories related to poker skills can be ranked against the scores of other end users, to give the participant the ability to judge how his or her skills compare to the skills of other players. We could produce a numerical score which indicates the skill level of a poker player. One way to determine this score is by using statistics, and assuming a normal distribution. For example, the average (mean) score can be set at a value such as 100, and the standard deviation fixed at a number such as 15 (such as is often done with IQ scores). This can be accomplished using well-known statistical formulas.

This also could be the basis of a contest to see who can get the best score. We could also produce individual numerical scores in various skills areas related to poker; some possible examples being "Knowing the Odds", "Respecting Previous Action", "Adjusting to Opponents' Styles", "Bluffing", "Blind Defense", Aggressive Play", "Playing too Tight", "Position", and "Continuation Betting".

In another embodiment, the end user cannot only receive a detailed analysis at the end of the poker session, but at set intervals such as every 50 hands.

In another embodiment, the end user cannot only receive a detailed analysis at the end of the poker session or at set intervals, but at any time they desire by clicking on a button labeled "Check my performance" or similarly.

Dynamic analysis generally occurs "on the fly", meaning that while the end user is playing the game, dynamic analysis is constantly taking place in the background. However, in another embodiment, the actions taken by the end user are stored in a database. After a preset time period or number of hands, the software engine analyzes all the data at once to produce the output for the end user. The output of the system may be a multi-page analysis document in a format such as HTML, specifically created for the participating player and listing the skill areas in which they most need improvement.

In yet another embodiment, the analysis of strategy made available to the end user takes the form of a "move-by-move replay", in which the end user can watch a replay of all of the poker hands played, while the software gives advice at every decision point. This is a most effective method from which to learn, in the same way that professional athletes often videotape their games for later review.

Although the description above contains many specificities, these should not be construed as limiting the scope of the embodiment but as merely providing illustrations of some of the presently known embodiments. For example, the final output of the analysis for the end user might not only be an analysis document, but a scoring chart or improvement graph, or even an audio report with synthesized speech. Thus the scope of the embodiment should be determined by the appended claims and their legal equivalents, rather than by the examples given.

The present application includes any novel feature or combination of features disclosed herein either explicitly or any generalization thereof. While the features have been described with respect to specific examples including modes of carrying out the invention, those skilled in the art will appreciate that there are numerous variations and permutations of the above described systems and techniques. Thus, the spirit and scope of the invention should be construed broadly as set forth in the appended claims. Furthermore, not all embodiments contain all improvements.

Many examples in this document used Texas Hold'em poker as the poker game, since it is by far the most popular form of poker at the present time. The principles presented, however, are not limited to Texas Hold'em poker, and the invention should be interpreted broadly to apply to all forms of poker (including poker tournaments) except when restricted in the claims.

Finally, it should be noted that the included glossary of terms (including poker terms) is an integral part of this document. The terms in used this document are governed by the glossary, even when the definition of a term differs from mainstream usage.

We claim:

1. A method of providing analysis of an individual's performance in a poker game, comprising:

a. providing one or more computer processor systems;

b. providing processor executable code allowing an end user to participate in a poker game against one or more opponents in an Internet browser;

c. providing a software engine; said software engine performing an analysis of strategy for said end user; said analysis of strategy based on one or more decisions made by said end user at one or more decision points of said poker game;

d. causing said analysis of strategy to be made available to said end user upon request via a storage medium or computer output device; whereby helping said end user to improve their performance at future poker games or providing entertainment for said end user.

2. The method of claim 1 wherein said analysis of strategy is dynamic analysis.

3. The method of claim 1 wherein said poker game is the variant known as Hold'em poker.

4. The method of claim 1 wherein said opponents are computerized opponents that use artificial intelligence or pre-programmed actions.

5. The method of claim 1 wherein said opponents are comprised of one of more human opponents and zero or more computerized opponents; said computerized opponents using artificial intelligence or pre-programmed actions.

6. The method of claim 1 wherein said poker game is comprised of non-random poker hands, wherein the cards dealt in said poker hands are pre-determined.

7. The method of claim 1 wherein said poker game is comprised of poker hands that are random.

8. A system for analyzing an individual's performance in a poker game, comprising:

a. one or more computer processor systems;

b. processor executable code allowing an end user to participate in a poker game;

c. an Internet browser on said computer processor system; said end user participating in said poker game in said Internet browser against one or more opponents;

d. a software engine executing on said computer processor system or over a network; said software engine performing an analysis of strategy for said end user; said analysis of strategy based on one or more decisions made by said end user at one or more decision points of said poker game;

e. a storage medium or computer output device for receiving an analysis output for said end user upon request; whereby helping said end user to improve their performance at future poker games or providing entertainment for said end user.

9. The system of claim 8 wherein said analysis engine performs dynamic analysis.

10. The system of claim 8 wherein said poker game is the variant known as Hold'em poker.

11. The system of claim 8 wherein said opponents are computerized opponents that use artificial intelligence or pre-programmed actions.

12. The system of claim 8 wherein said opponents are comprised of one of more human opponents and zero or more computerized opponents; said computerized opponents using artificial intelligence or pre-programmed actions.

13. The system of claim 8 wherein said poker game is comprised of non-random poker hands, wherein the cards dealt in said poker hands are pre-determined.

14. The system of claim 8 wherein said poker game is comprised of poker hands that are random.

15. A method of providing dynamic analysis of an individual's performance in a poker game, comprising:

a. providing one or more computer processor systems;

b. providing processor executable code allowing an end user to participate in a poker game against one or more opponents;

c. providing a software engine; said software engine performing a dynamic analysis of strategy for said end user; said dynamic analysis of strategy based on a plurality of skills evaluated both separately and in aggregate over a plurality of decisions made by said end user at a plurality of decision points of said poker game;

d. causing said dynamic analysis of strategy to be made available to said end user upon request via a storage medium or computer output device; whereby helping said end user to improve their performance at future poker games or providing entertainment for said end user.

16. The method of claim 15 wherein said poker game is the variant known as Hold'em poker.

17. The method of claim 15 wherein said opponents are computerized opponents that use artificial intelligence or pre-programmed actions.

18. The method of claim 15 wherein said opponents are comprised of one of more human opponents and zero or more computerized opponents; said computerized opponents using artificial intelligence or pre-programmed actions.

19. The method of claim 15 wherein said poker game is comprised of non-random poker hands, wherein the cards dealt in said poker hands are pre-determined.

20. The method of claim 15 wherein said poker game is comprised of poker hands that are random.

* * * * *